United States Patent [19]

Stahle

[11] 4,349,322

[45] Sep. 14, 1982

[54] COOLING A MOTOR OF A CENTRIFUGAL PUMP FOR CONVEYING LIQUIDS WITH DEPOSITED SOLIDS

[76] Inventor: Martin Stahle, Postfach 12, CH-8213 Neunkirch, Switzerland

[21] Appl. No.: 12,075

[22] Filed: Feb. 14, 1979

[30] Foreign Application Priority Data

Feb. 14, 1978 [CH] Switzerland ..... 1596/78

[51] Int. Cl.[3] ..... F04B 39/06

[52] U.S. Cl. ..... 417/370; 415/169 A

[58] Field of Search ..... 417/369, 370; 415/169 A

[56] References Cited

U.S. PATENT DOCUMENTS 2,301,063 11/1942 McConaghy ..... 417/370
3,535,051 10/1970 Turner ..... 415/169 A
3,572,976 3/1971 Sato ..... 417/369

FOREIGN PATENT DOCUMENTS 499726 1/1971 Switzerland .

*Primary Examiner*—Richard E. Gluck
*Attorney, Agent, or Firm*—Browdy and Neimark

[57] ABSTRACT

A centrifugal pump for conveying liquids with deposited solids has two grooves winding in opposite directions around the impeller axle from the inside to the outside, one groove being in the radial annular surface of the sealing cover of the pump housing and the other in the impeller hub. These surfaces rotate relative to each other and are separated from each other by a leakage gap. The radial inner wall of each groove forms a shearing edge with the adjacent annular surface and the grooves open outwardly towards the surge chamber of the pump housing and inwardly towards a central leakage-collecting chamber. The collecting chamber is connected to the cooling jacket of a pump motor and an outlet leads back to the suction inlet of the pump. Water penetrating into the leakage gap cools the motor and solids penetrating into the gap are separated by the shearing edges from the annular surfaces and forced back to the pressure side of the pump by the grooves.

2 Claims, 6 Drawing Figures

COOLING A MOTOR OF A CENTRIFUGAL PUMP FOR CONVEYING LIQUIDS WITH DEPOSITED SOLIDS

DESCRIPTION

1. Technical Field

This invention relates to pumps. In particular the invention is directed to the cooling of a motor of a centrifugal pump which is used for conveying liquids with deposited solids. Such pumps usually have a spiral housing and an axial suction opening.

2. Background

The cooling of motors of centrifugal pumps by means of an oil stream is well known. The cooling effect of such an arrangement is effective, but the installation of such a system is relatively expensive and problems of soundness, maintenance and repair exist. Another approach to the cooling of pump motors is to employ the liquid being pumped also for cooling the motor. This approach results in considerable pollution of the cooling system especially in the case of sewage pumps. Further, the type and proportion of the deposited solids can also vary widely and this can result in corresponding changes in the cooling effect.

It is well known in centrifugal pumps, for example, in Swiss Patent CH-PS No. 499 726, to have a radial housing surface which is grazed by an impeller hub, wherein the housing surface is provided with a spiral groove with shearing edge. This groove prevents solids which have infiltrated into the unavoidable gap between a sealing cover and the hub, from settling there, and the shearing edge of the groove has the effect that these solids are prevented from moving radially inwardly and getting into the groove. As a result the solids are forced radially outwards into the pressure side of the pump again. This expulsion of solids has not been found to be as effective as it might be. An object of this invention is to minimize the disadvantages enumerated above. It is directed to creating a cooling arrangement which has the advantage of a "clean" coolant, without having to be dependant on an extraneous liquid such as oil.

DISCLOSURE OF INVENTION

In a pump and a motor, there is a pump having a housing, a suction opening and an outlet, a sealing cover for the housing and an annular surface for the sealing cover of the pump housing, an impeller having an annular surface, such impeller surface rotating in closely spaced relationship with the sealing cover. In the face of the sealing cover, there is a groove spiraling outwardly from the impeller axis from the inside to the outside. The direction of the spiral is in the rotational direction of the impeller. The inner boundary edge of the groove provides a shearing edge and the outer end of the groove discharges into the pressure side of the pump housing and the inner end of the groove discharges into a water leakage-collecting chamber situated between impeller and sealing cover. The chamber is connected by a pipe with the inlet of the motor-cooling jacket.

Thus the radial inner end of the groove as well as the gap between the above mentioned annular surfaces discharge inwardly, into the seepage-collecting channel, liquid which is practically free of solids and this in turn, as cooling liquid into the motor jacket, from which it is directed back again into the suction pipe of the pump.

Sufficient cleaning or separation of the liquid from solids and an adequately large flow of cooling liquid is obtained by arranging on the annular surface of the impeller hub a groove with a shearing edge winding helically around the impeller axle or axis from the inside to the outside. The winding direction of the groove is opposite to the rotational direction of the impeller; the shearing and ejecting effect of the overlapping grooves is considerably improved in relation to having only one groove in the housing. It has been shown, for example, that with sewage pumps of the type between 0.5 and 1 mm horizontal gap widths and two grooves, a sufficiently large, water-leakage stream, free of solids, for cooling the motor is obtained.

Cooling liquid practically free of solids infiltrating into the collecting chamber is effectively introduced tangentially into the cooling jacket of the motor and is directed out of the cooling jacket at an axially displaced point. This way a rotational flow occurs in the cooling jacket, which not only guarantees a faultless cooling effect, but also prevents solid particles still present in the cooling liquid from being deposited in the cooling jacket.

BRIEF DESCRIPTION OF DRAWINGS

My invention is described more closely below with reference to the accompanying drawings, which are.

Figure 3:
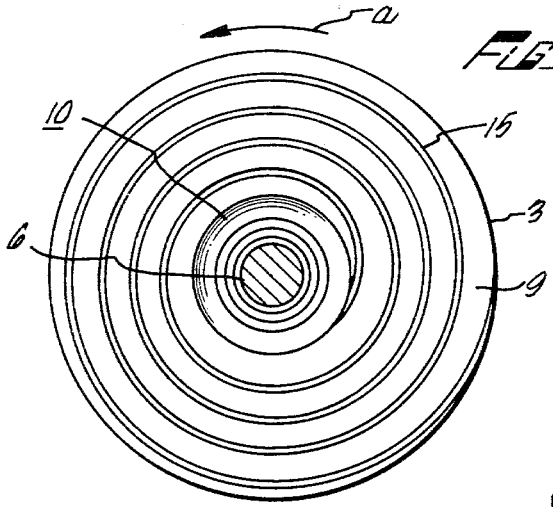
Figure 2:
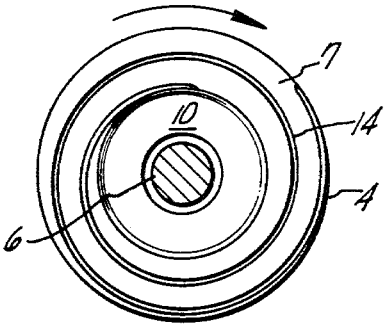
Figure 1:
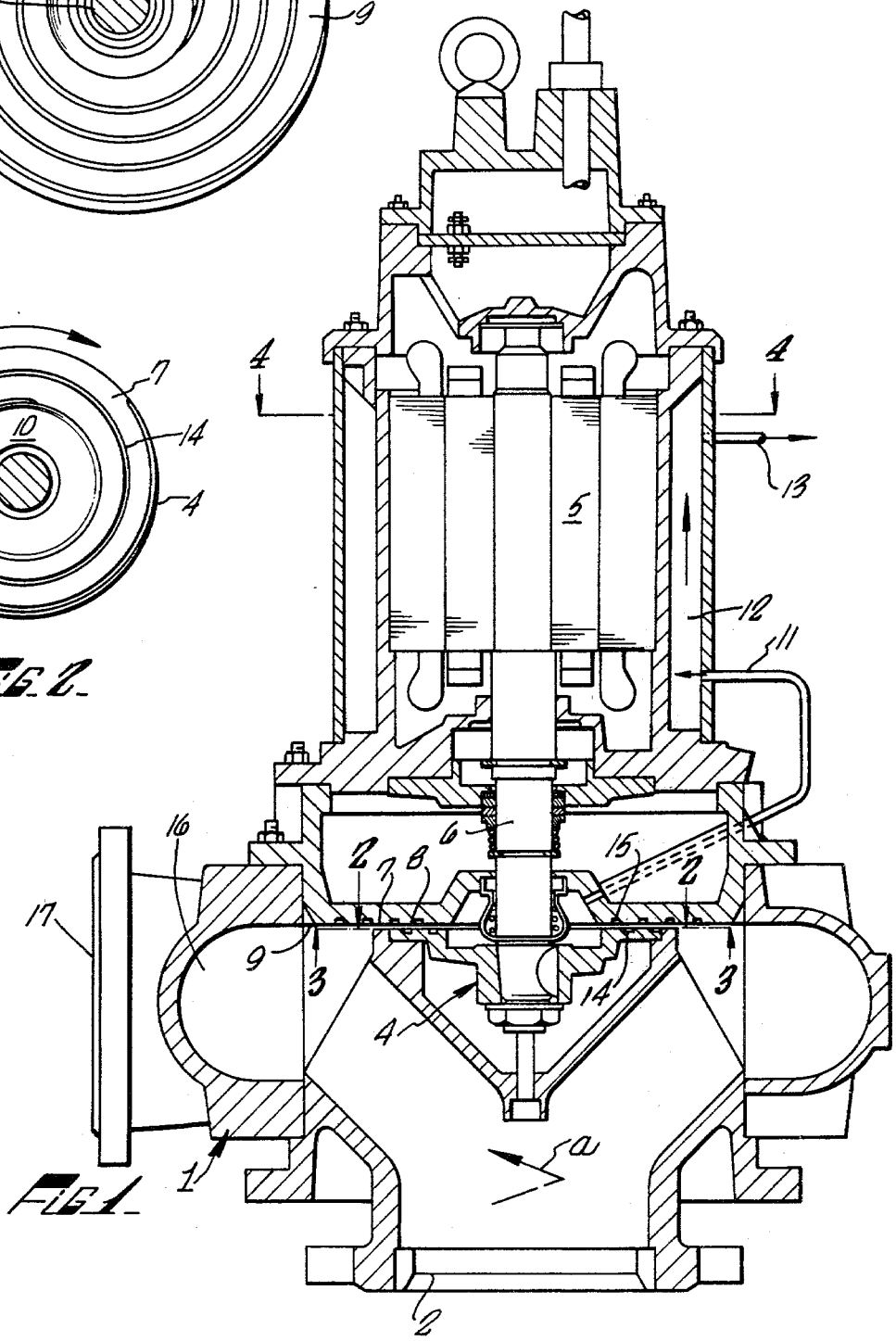
FIG. 1-a sewage centrifugal pump with a motor-cooling arrangement in axial section according to the invention, FIG. 2-a plan view of the impeller hub in direction of arrows 2—2 in conformity with FIG. 1, FIG. 3-a plan view of the housing cover, grazed by the impeller hub, in direction of arrows 3—3 in conformity with FIG. 1, FIG. 4-a cross section view along line 4—4 in FIG. 1, FIG. 5-an axial section in larger scale through the parts of the impeller hub and housing cover provided with spiral grooves running in opposite directions, according to FIG. 1, and FIG. 6-the overlapping grooves in cover and hub in plan view of the housing cover according to FIG. 5.
Figure 4:
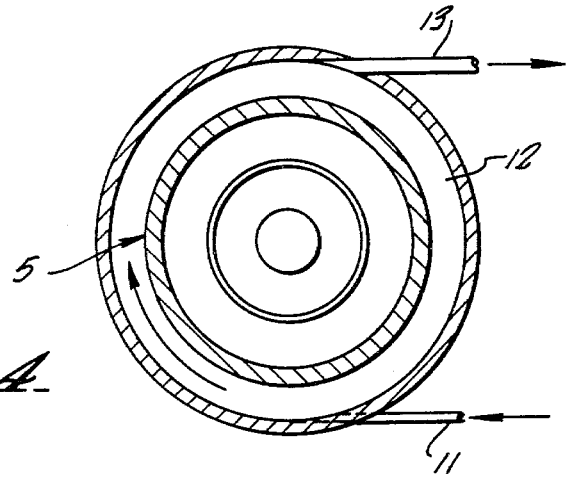

The sewage centrifugal pump shown in FIG. 1 has a pump housing 1 with an axial suction opening 2 and an opposite sealing cover 3 and outlet 16 and part 17. On one side of cover 3 there projects a pump impeller with hub 4 and on the other side of cover 3 there projects a pump shaft 6, bearing the rotor of the electric driving motor 5. A radial annular surface 7 of the impeller hub 4 grazes in closely spaced relationship a radial annular surface 9 of the sealing cover 3, leaving a leakage gap 8. Through appropriate cavities, radially within the two annular surfaces 7, 9, a water leakage-collecting chamber 10 is formed between the housing cover 3 and impeller hub 4 and is connected by the gap 8 with the pressure side of the pump channel. Moreover, the collecting chamber 10 is connected with a cooling jacket 12 surrounding the motor 5 by a pipe 11, and in fact through an inlet discharging tangentially into the cooling jacket in the area of an axial end of this cooling jacket. An outlet in the area of the other end of the cooling jacket discharges, and this is connected (not shown) to the suction pipe of the pump by a pipe 13. If the pump is arranged in a sump, then the cooling jacket 12 could be open at the top and form an overflow for the cooling water, making the pipe 13 unnecessary.

Figure 6:
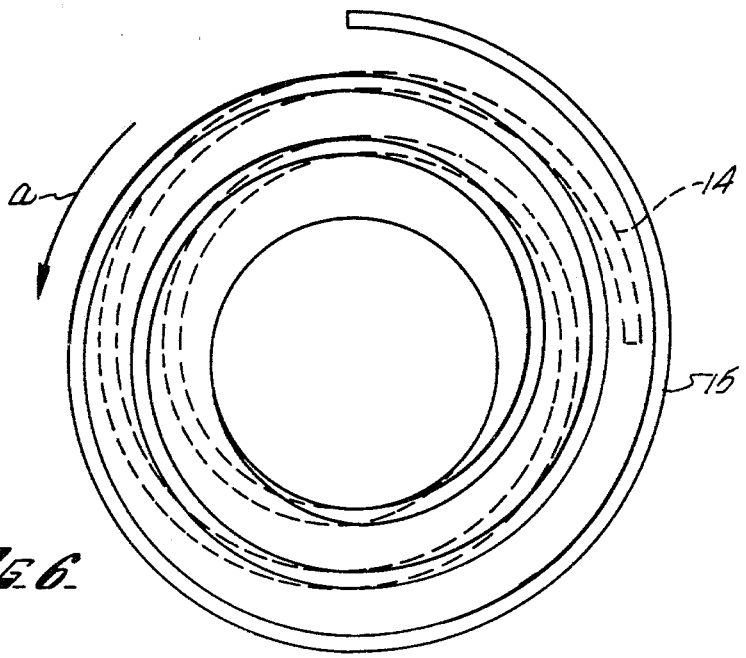

A groove 14 winding spirally around the pump axle from the inside to the outside is provided in the annular surface 7 of the impeller hub, the winding direction of the groove 14 being opposite to the rotational direction "a" of the impeller. In the annular surface 9 of the housing cover 3 there is an analogous groove 15 which winds spirally around the pump axle from the inside to the outside. The winding direction of this groove 15 is the same as the rotational direction "a" of the impeller. It is thereby achieved, as seen in FIG. 6, that the two open grooves 14, 15 in a radial direction inwardly towards the collecting chamber 10 and radial direction outwardly towards the pressure side of the pump housing 1, overlap (FIG. 6).

Figure 5:
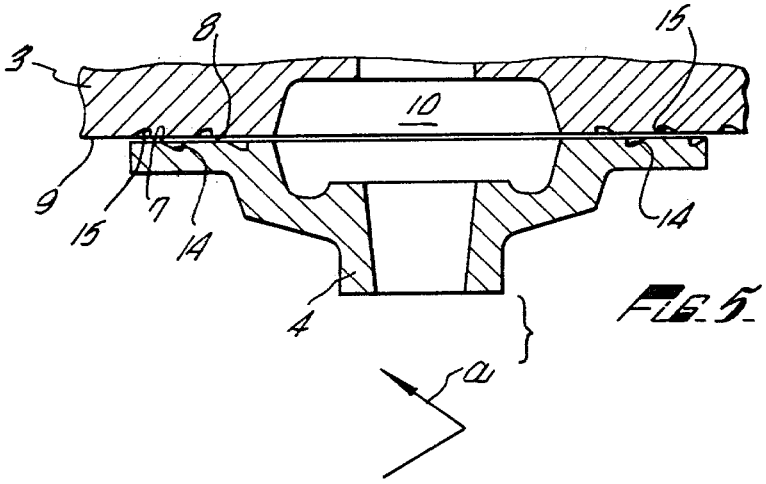

As can be seen from FIG. 5 of the drawing, the grooves 14 and 15 have a trapezoidal cross section, whereby the radially inner wall of the groove forms a shearing edge with the annular surfaces 7 and 9 respectively. The grooves could also be triangular, rectangular or semicircular in cross section, whereby the groove wall forming the deflecting surface with the shearing edge can be given a hard metal facing. In FIG. 1, rectangular cross-sectional grooves are illustrated.

In operation of the described pump, water gets out of the surge chamber of the housing 1 through the leakage gap 8 into the water leakage-collecting chamber 10, but solids carried forward are kept back by the overlapping shearing edges of the two grooves 14 and 15, where they are skimmed off and are forced radially outwards by the deflecting surfaces to the pressure side of the pump housing 1. In this way not only is the cooling water cleaned, but a blocking of the leakage gap is also prevented. The water, practically free of solids, infiltrating into the collecting chamber 10 gets into the cooling jacket 12 and returns to the suction pipe of the pump through the pipe 13.

The cooling installation requires no special coolant and is supplied with the flow medium of the pump itself. It is structurally simple and, due to the effective cleaning of seepage containing solids before its entry into the cooling jacket and the rotational flow produced in the latter, it requires little maintenance.

Although the invention has been described with reference to a sewage-centrifugal pump it is obvious that it is applicable to pumps for the other applications. Further, the term "impeller hub" as used herein is synonymous with the term "impeller", since, for example, the grooves can be provided in the impeller itself (and of which the hub forms part). The above description of the present invention is susceptible to various other modifications, changes and adaptations, and the invention is not to be limited to the details herein but is of the full scope of the appended claims.

I claim:

1. A centrifugal pump for conveying liquids with solids including a pump housing, a suction inlet, an outlet, a sealing cover for the housing and an annular surface for the sealing cover, an impeller having an annular surface, a pump shaft, the impeller being adapted for rotation by the shaft such that the respective annular surfaces are in closely spaced relationship, at least one groove formed in the annular surface of the sealing cover spiraling outwardly around the impeller axis, the annular surface of the impeller being formed with at least one groove, said groove spiraling outwardly around the impeller axis and opening at its outer end into an elevated pressure side of the housing, a liquid collecting chamber centrally located about the shaft between the impeller and the sealing cover, the outer end of the sealing cover groove opening into the pressure side of the housing, the chamber having an outlet for connection to a cooling jacket of a motor for the pump, and the chamber being formed partly by a cavity in the annular surface of the impeller and partly by a cavity in the sealing cover.

2. A centrifugal pump as claimed in claim 1 wherein the spiral direction from the inside to outside of the impeller groove is opposite to the rotational direction of the impeller and the spiral direction of the sealing cover groove from inside to outside is in the rotational direction of the impeller.

* * * * *